US010794352B2

(12) United States Patent
Mehr

(10) Patent No.: US 10,794,352 B2
(45) Date of Patent: Oct. 6, 2020

(54) METHOD FOR STARTING AN INTERNAL COMBUSTION ENGINE

(71) Applicant: MTU FRIEDRICHSHAFEN GMBH, Friedrichshafen (DE)

(72) Inventor: Andreas Mehr, Kressbronn (DE)

(73) Assignee: MTU FRIEDRICHSHAFEN GMBH, Friedrichshafen (DE)

( * ) Notice: Subject to any disclaimer, the term of this patent is extended or adjusted under 35 U.S.C. 154(b) by 0 days.

(21) Appl. No.: 16/338,173

(22) PCT Filed: Jul. 13, 2017

(86) PCT No.: PCT/EP2017/000838
§ 371 (c)(1),
(2) Date: Mar. 29, 2019

(87) PCT Pub. No.: WO2018/072859
PCT Pub. Date: Apr. 26, 2018

(65) Prior Publication Data

US 2019/0277238 A1 Sep. 12, 2019

(30) Foreign Application Priority Data

Oct. 17, 2016 (DE) ..... 10 2016 012 403

(51) Int. Cl.

| | |
|---|---|
| ***F02N 9/04*** | (2006.01) |
| *F02B 3/06* | (2006.01) |
| *F02B 21/00* | (2006.01) |
| *F02N 7/08* | (2006.01) |
| *F02N 15/10* | (2006.01) |

(52) U.S. Cl.
CPC ..... *F02N 9/04* (2013.01); *F02B 3/06* (2013.01); *F02B 21/00* (2013.01); *F02N 7/08* (2013.01); *F02N 15/10* (2013.01)

(58) Field of Classification Search
CPC ... F02N 9/04; F02N 15/10; F02N 7/08; F02B 21/00; F02B 3/06
USPC ..... 123/182.1, 179.31
See application file for complete search history.

(56) References Cited

U.S. PATENT DOCUMENTS

| | | | |
|---|---|---|---|
| 3,572,306 | A | 3/1971 | Hurlimann |
| 3,667,442 | A | 6/1972 | Bredlow |
| 4,162,668 | A | 7/1979 | Jacob |

(Continued)

FOREIGN PATENT DOCUMENTS

| | | | |
|---|---|---|---|
| DE | 1922946 | A1 | 12/1969 |
| DE | 2632015 | A1 | 1/1978 |
| DE | 3020930 | A1 | 12/1981 |

(Continued)

OTHER PUBLICATIONS

International Search Report, dated Oct. 4, 2017, 2 Pages.

*Primary Examiner* — Hai H Huynh
(74) *Attorney, Agent, or Firm* — Lucas & Mercanti, LLP; Klaus P. Stoffel

(57) ABSTRACT

A method for starting an internal combustion engine by a compressed air starting system, in which in a first starting sequence the engagement of the starter is brought about by compressed air, a decompression valve for relieving the cylinder working space is acted on in the opening direction, and starting of the internal combustion engine is initiated by pulsed compressed air being applied to the starter. In a second starting sequence the decompression valve is acted on in the closing direction, and constant compressed air is applied to the starter.

5 Claims, 5 Drawing Sheets

(56) References Cited

U.S. PATENT DOCUMENTS 4,494,499 A 1/1985 Stein

FOREIGN PATENT DOCUMENTS

| | | | |
|---|---|---|---|
| DE | 19724921 | A1 | 12/1998 |
| GB | 2077361 | B | 1/1984 |
| GB | 2329427 | B | 11/2000 |
| WO | 2013076357 | A1 | 5/2013 |

METHOD FOR STARTING AN INTERNAL COMBUSTION ENGINE

CROSS-REFERENCE TO RELATED APPLICATIONS

The present application is a 371 of International application PCT/EP2017/000838, filed Jul. 13, 2017, which claims priority of DE 10 2016 012 403,2, filed Oct. 17, 2016, the priority of these applications is hereby claimed and these applications are incorporated herein by reference.

BACKGROUND OF THE INVENTION

The invention relates to a method for starting an internal combustion engine by means of a compressed air starting system, wherein in a first start sequence the engagement of the starter is brought about by means of compressed air and in a second start sequence compressed air is applied to the starter.

An internal combustion engine is started either by means of an electrically actuated starter or by means of a compressed air starter. A compressed air starting system is known by way of example from DE 26 32 015 OS. Typically, a starting procedure in the case of a compressed air starting system comprises a first and a second start sequence. In the first start sequence, the starter is brought into engagement by means of compressed air and in the second start sequence the starter is set into a rotational movement via the compressed air. The second start sequence is complete if the internal combustion engine has achieved an idling rotational speed, for example 350 revolutions/minute. Following this, the operation of running the combustion engine begins, in that the fuel is injected. In the case of an internal combustion engine that is used to drive a ship, the cylinders are equipped with decompression valves for relieving pressure in the cylinder working chamber. This procedure in the case of the second start sequence carries away from the cylinder chamber any water that may have penetrated. In practice, the problem now occurs that it is necessary for the starter to produce a considerable releasing torque so as to initially start up the internal combustion engine. If the releasing torque is overcome, then the internal combustion engine temporarily rotates at a high rotational speed. In conjunction with residual water in the cylinder chamber, this is critical for the connecting rod.

SUMMARY OF THE INVENTION

The object of the invention is therefore to provide an improved method for starting an internal combustion engine by means of a compressed air system.

This object is achieved by virtue of a method, wherein in a first start sequence an engagement of the starter is brought about by means of compressed air, a decompression valve is acted upon in the opening direction so as to relieve the pressure in the cylinder working chamber and also a procedure of starting up the internal combustion engine is initiated in that pulsed compressed air is applied to the starter. In a second start sequence, the decompression valve is then acted upon In the closing direction and constant compressed air is applied to the starter.

In so doing, a compressed air path for bringing the starter into engagement is determined by a system controller via an engagement valve and a compressed air path for starting up the starter is determined via a start valve in the first start sequence and also for rotating the starter in the second start sequence. The pulse compressed air is generated by virtue of the fact that during the first start sequence the start valve is controlled via a PWM signal in dependence upon a desired engine rotational speed. In other words, the starter is continuously controlled in a gentle manner via the PWM signal and the pulsed compressed air. An abrupt transition from an internal combustion engine that is at a standstill to a rotating internal combustion engine is thus avoided.

In addition, it is provided that the desired rotational speed is increased in a ramp-shaped manner from a first desired rotational speed value to a second desired rotational speed value. The first start sequence is ended in a positive manner if a rotational speed control deviation between the desired rotational speed and the actual rotational speed Is detected within a tolerance band, for example 10 revolutions/minute.

The method offers overall a high degree of process reliability and renders possible as an additional safety measure a sales-promotional argument. As a purely software solution, this is almost cost-neutral. In addition, it is possible to retrofit the invention without any problem since the function merely uses the already existing components.

BRIEF DESCRIPTION OF THE DRAWING

A preferred exemplary embodiment is illustrated in the figures. In the drawings.

DETAILED DESCRIPTION OF THE INVENTION

Figure 1:
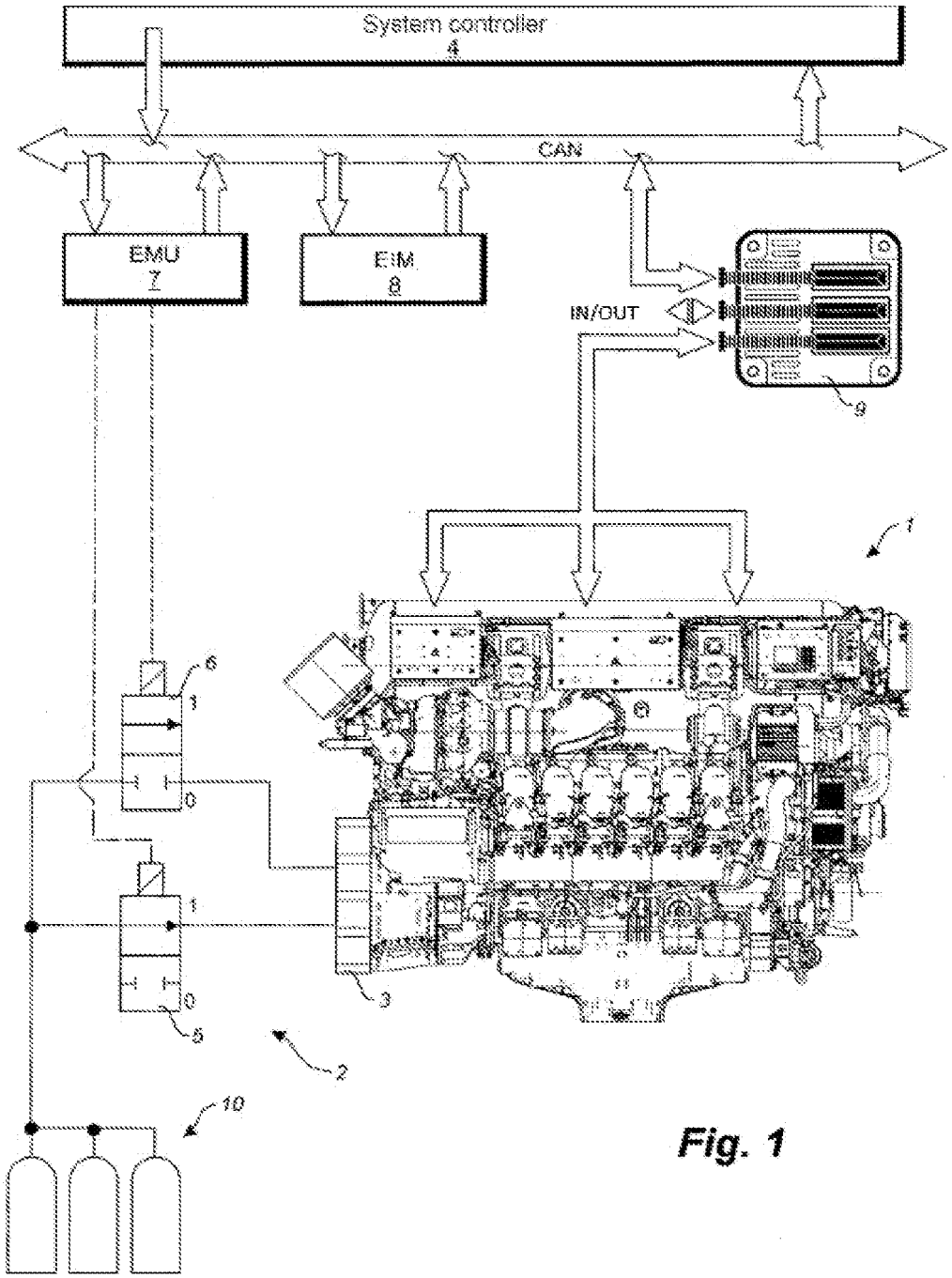
FIG. 1 illustrates a system diagram.

FIG. 1 illustrates a system diagram of an internal combustion engine 1 having a compressed air starting system 2. The compressed air starting system 2 includes a compressed air storage device 10 for providing the compressed air, an engagement valve 5 and a control valve 6. The engagement valve 5 and the control valve 6 are configured as 2/2 valves. Alternatively, 3/2 valves may also be used. FIG. 1 illustrates the engagement valve 5 in the position one with the result that a continuous compressed air path is provided from the compressed air storage device 10 to the starter 3 via the engagement valve 5. In this position, the starter is brought into engagement. The start valve 6 is illustrated in the position zero in which the compressed air path from the compressed air storage device 10 to the starter is blocked, in other words the starter is not rotating. The operating state of the entire system is determined by a system controller 4. A user indicates via the system controller 4 his/her desire for the activation/deactivation or his/her desire for power. A monitoring unit 7 (EMU), an interface unit 8 (EIM) and an engine control unit 9 are connected to the system controller 4 via a CAN bus. The monitoring unit 7 determines in turn the switching state of the engagement valve 5 and of the start valve 6. This typically occurs via a PWM signal. The function of the monitoring unit 7 and the function of the interface unit 8 are explained in detail in conjunction with FIG. 2. The engine control unit 9 controls the state of the internal combustion engine 1 in an open-loop and closed-loop manner. In the operation of running the combustion engine, these are by way of example a rail pressure, start of an injection procedure and end of an injection procedure. The figure illustrates the other input and output variables by means of the reference signs IN/OUT, by way of example a switching signal for the switchable exhaust gas turbo charger in the case of a sequential turbocharging procedure.

Figure 2A:
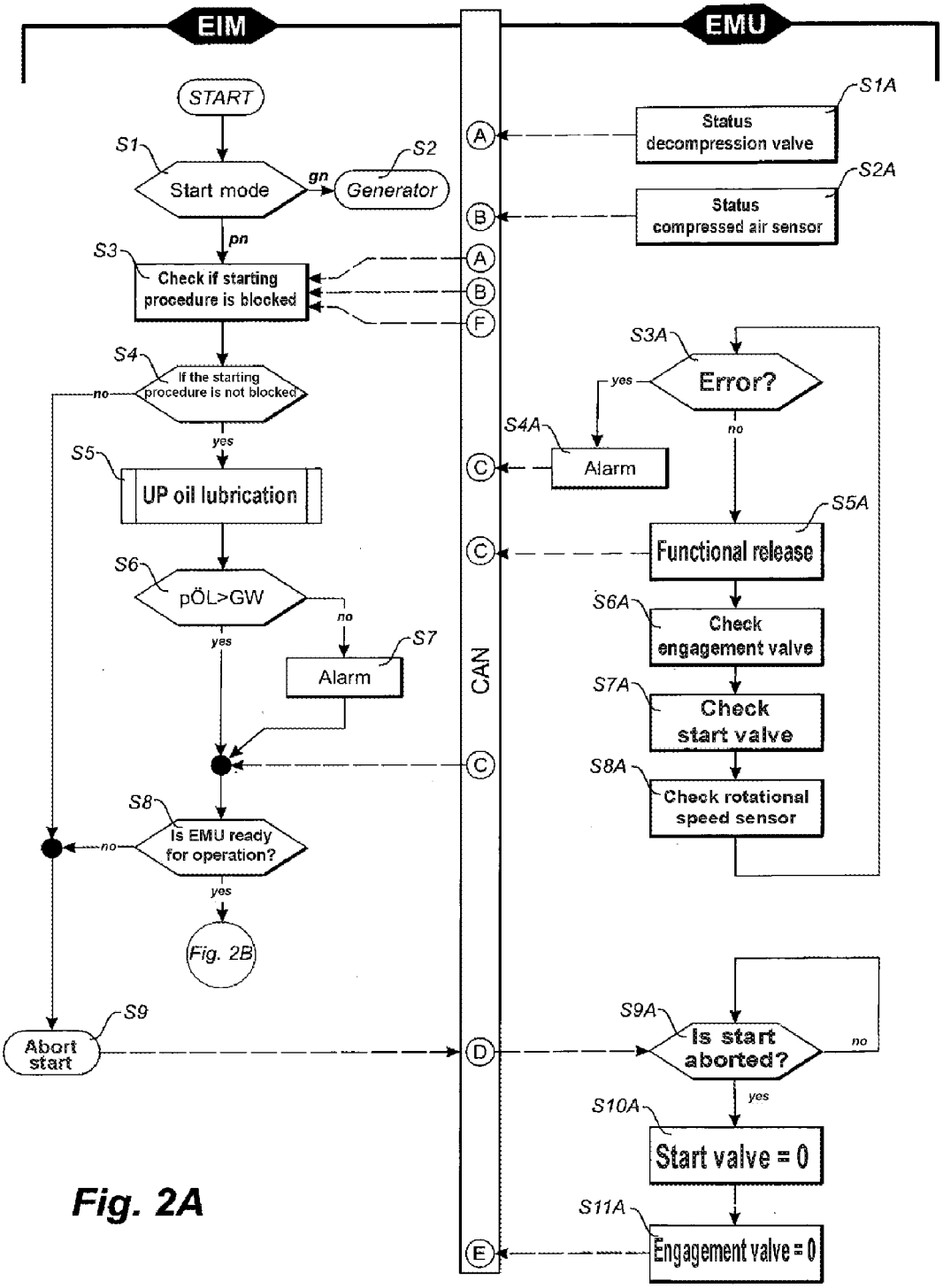
FIG. 2A illustrates the program part for preparing and testing the startup procedure.
Figure 2B:
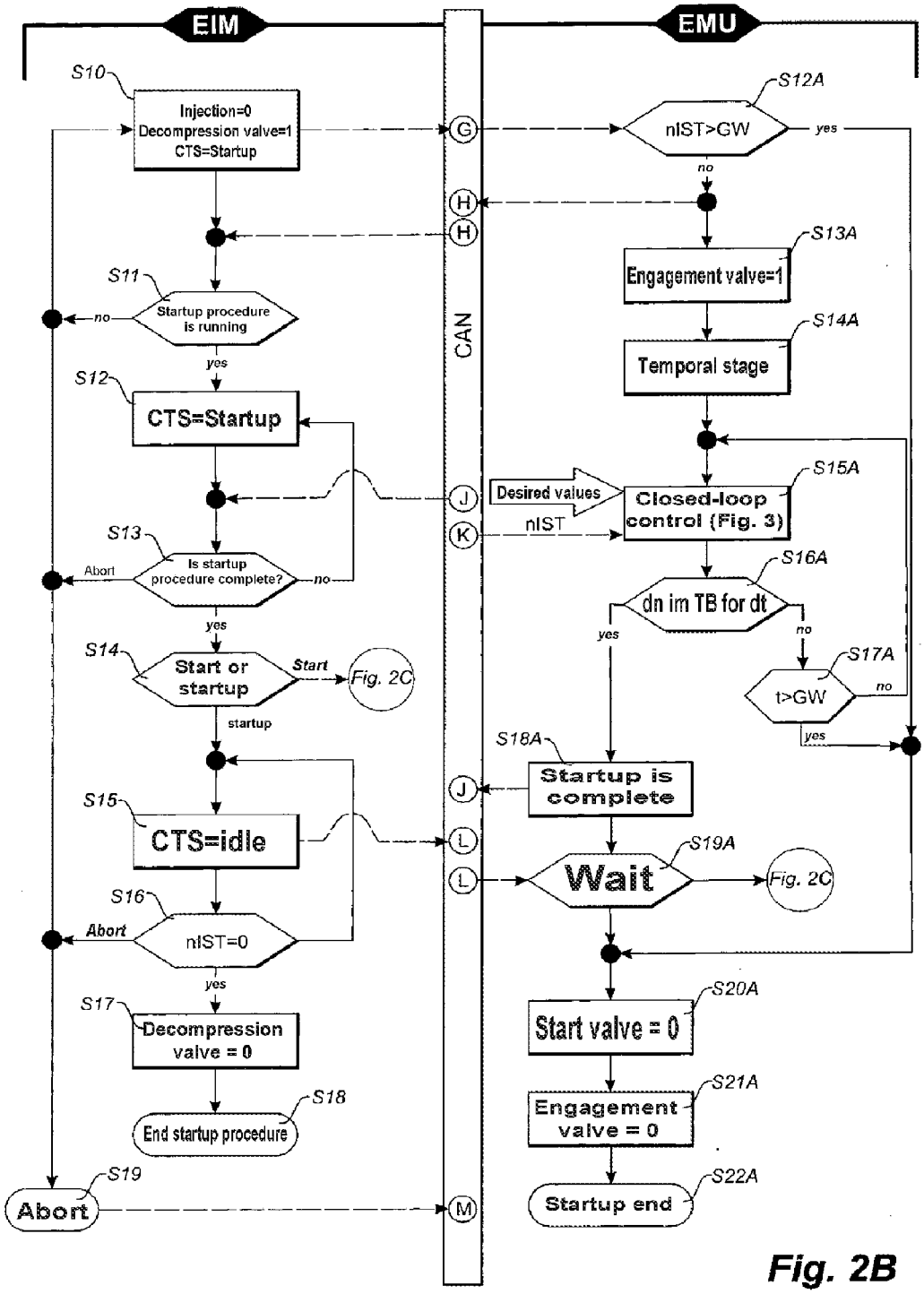
FIG. 2B illustrates the program part of the first start sequence.
Figure 2C:
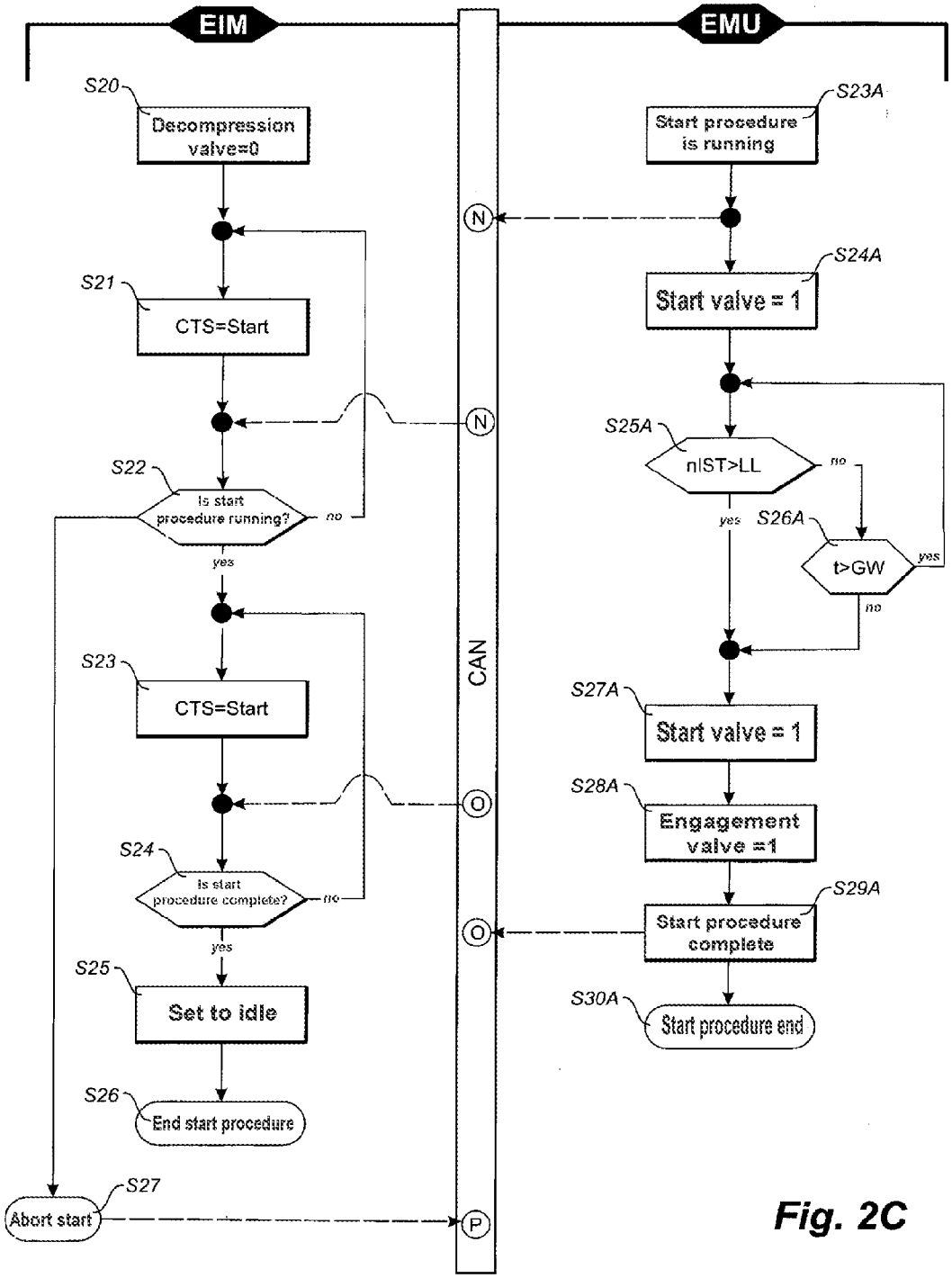
FIG. 2C illustrates the program part, of the second start sequence.

FIG. 2 illustrates a program flow chart. FIG. 2 consists of the part FIGS. 2A, 2B and 2C. In this case, FIG. 2A illustrates the program part for preparing and testing the startup procedure, FIG. 2B illustrates the program part of the first start sequence and figure 2C illustrates the program part of the second start sequence. The reference sign EMU identifies the program sequence in the monitoring unit 7. The reference sign EIM identifies the sequence in the interface unit 8. The interface unit 8 (EIM) and the monitoring unit 7 (EMU) communicate via a CAN bus. Data that is set or queried on the CAN bus is indicated by the broken arrows. In step S2A, by way of example, the compressed air sensor places its status signal on the CAN bus. reference letter B. This status signal is read in by the CAN bus, reference letter B, in step S3 from the interface unit 8 (EIM).

The program sequence of the monitoring unit (EMU) is described first below. In step S1A, the status of the decompression valve is established open/closed and is set as a value on the CAN bus, reference letter A. In step S2A, the state of the compressed air sensor and also of the compressed air is determined and set as a status value, reference letter B on the CAN bus. The steps S3A to S8A characterize an error query and demonstrate that the monitoring unit is ready for operation. A check is initially performed in step S3A as to whether an error has been detected. In the event that an error has been detected, query result S3A: yes, an alarm is displayed in S4A and this is set for further processing on the CAN bus, reference letter C. If it is established in step S3A that an error has not occurred, then the functional release is confirmed in S5A, reference letter C, and subsequently in step S6A the status of the engagement valve (FIG. 1:5), in step S7A the status of the start valve (FIG. 1:6) and in step S8A the status of the rotational speed sensor are queried. Following this, the program then branches back to step S3A. The steps S9A to S11A characterize the approach when aborting a start. In step S9A, a check is performed as to whether an abort start demand has been set by the monitoring unit (EIM) on the CAN bus, reference letter D. In the event that an abort start procedure has been initiated, the start valve is then deactivated in step S10A and the engagement valve is deactivated in step S11A and this is indicated on the CAN bus for further processing, reference letter E.

The program sequence of the interface unit (EIM) begins in step S1 by querying the start mode. This is predetermined by the user via the system controller. Accordingly, either the engine start by means of a generator, step S2, or a start by means of a compressed air system is selected. In step S3, a check is performed as to whether the starting procedure is blocked. For this purpose, the set status of the decompression valve (reference letter A) of the air pressure sensor (reference letter B) and the presence of an external stop signal are queried on the CAN bus. The stop signal, reference letter F, is set by the system controller on the CAN bus. Following this, in step S4, the result of the query as to whether the starting procedure is blocked is queried. If a switching block is set, then the start is aborted in step S9 and displayed on the CAN bus, reference letter D. If the starting procedure is not blocked, then in step S5 the program branches to the sub-program of oil lubrication and subsequently in step S6 a check is performed as to whether the oil pressure pÖL is greater than a limit value GW. In the event of an error, query result S6: no, in step S7 an alarm for the user is set and the program branches to step S8, In the case of correct oil lubrication, the query result S6: yes, a check is subsequently performed in step S8 as to whether the monitoring unit (EMU) is ready for operation. For this purpose, the operational ready status is read out on the CAN bus, reference letter C. If it has been established in step S8 that the monitoring unit (EMU) is ready for operation, then the program branches to FIG. 2B. If the result of the check is negative, in other words the monitoring unit (EMU) is not ready for operation, the program branches to step S9, the starting procedure is aborted and this status is set on the CAN bus, reference letter D.

Figure 3:
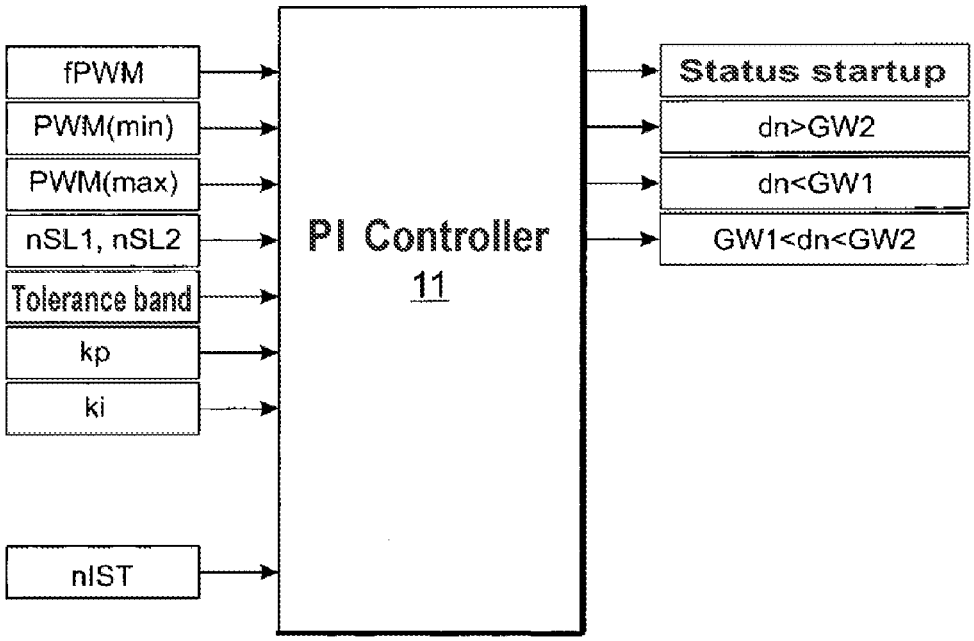
FIG. 3 illustrates an extract of the program flow chart.

FIG. 2B illustrates the program part of the first start sequence. The program sequence of the monitoring unit (EMU) is described first below. A check is performed in step S12A as to whether the actual rotational speed nIST is greater than a limit value GW. The limit value corresponds in this case to the maximum admissible rotational speed during the startup procedure, for example 20 revolutions/minute. In addition, the status of the monitoring unit (EIM) is queried, reference letter G. If the detected actual rotational speed is too high, query result S12A: yes, then the program branches to the program part with the steps S20A to S22A. If the actual rotational speed nIST is not greater than the limit value GW, query result S12A, then in step S13A the engagement valve is activated, as a result of which the starter is acted upon with compressed air and engaged. In step S14A, a temporal stage is run which corresponds to the time period of the engagement. In step S15A, a closed-loop control is activated. The essential features of this closed-loop control are illustrated in FIG. 3. The following input variables are available at a PI controller 11: the PWM frequency fPWM for controlling the engagement valve (FIG. 1:5) and for controlling the start valve (FIG. 1:6), a minimum pulse pause ratio PWM(min), a maximum pulse pause ratio PWM(max) for controlling the engagement valve and start valve, two desired rotational speed values nSL1 and nSL2, a tolerance band of the rotational speed, a proportional coefficient kp and an integral coefficient ki. Typical values for these input variables are: fPWM=8 HZ, PWM(min)=0%, PWM(max)=20%, nSL1=2 1/min; nSL2=10 1/min and tolerance band=10 1/min. In addition, the actual rotational speed nIST, the value of which is available on the CAN bus, is sent to the PI controller 11, reference letter K (FIG. 2B). Alternatively, the monitoring unit may also use a dedicated rotational speed sensor. The output variables of the PI controller 11 are the status of the startup procedure and the position of the deviation dn between the desired and actual rotational speed value with regard to a first limit value GW1 and a second limit value GW2.

The output variables of the PI controller are now further evaluated in step S16A of FIG. 2B. If during a time period dt the rotational speed control deviation dn lies within the tolerance band TB, query result S16A: yes, then in step S18A the startup procedure is recognized as being complete and set as the data value on the CAN bus, reference letter J. If, on the other hand, in step S16A a stable rotational speed control deviation is not detected, then in step S17A a temporal stage t is compared with a limit value GW. If the temporal stage t has ended, query result S17A; yes, then the program sequence is continued in step S20A. If, on the other hand, the temporal stage t is still running, query result S17A: no, then the program branches back to step S15A. If in step S18A the startup procedure is set as complete, then in step S19A a temporal stage is activated. During this temporal stage, a check is performed as to whether a switch should be made from the first start sequence into the second start sequence (FIG. 2C), whether the temporal stage has ended without success or whether the status is to be set to idle. For this purpose, during the temporal stage the status is queried on the CAN bus, reference letter L. In the event that the temporal stage has ended without success or if the status is set to idle, then in step S20A the start valve is deactivated, in step S21A the engagement value is deactivated and in step S22A the startup procedure is ended.

In step S10, the interface unit (EIM) sets the following states on the CAN bus, reference letter G: no fuel Injection, activate decompression valve, in other words activate Into open positions and a state variable CTS to startup procedure. A check is subsequently performed in step S11 as to whether the startup procedure is running. For this purpose, the corresponding value is read on the CAN bus, reference letter H. In the event of a negative check result, the startup procedure is aborted and the program branches to step S10. If in step S11 it is detected that the startup procedure is activated, query result S11: yes, then in step S12 the state variable CTS is set accordingly and in step S13 a check is performed as to whether the startup procedure has been performed completely. During this check, the status of the monitoring unit (EMU) is queried, reference letter J. If the startup procedure has not yet been completely performed, then the program branches to step S12. In addition, an error query is performed, which may result in the startup procedure being aborted. If the startup procedure is complete, query result S13: yes, in step S14 the decision is made as to whether the second start sequence is to be performed according to FIG. 2C or whether in step S15 the running variable CTS is to be set to idle. If the startup procedure is to be ended, then in step S15 the state variable CTS is set to idle and In addition set on the CAN bus, reference letter L. Following this, in step S16 the actual rotational speed nIST Is checked as to whether it is at a standstill (nIST=0). In the event that the check result is negative, in other words the internal combustion engine is already running, the program sequence is aborted, step S19 and reference letter M. If the check in step S16 is positive, then in step S17 the decompression valve Is actuated in the closing direction and in step S18 the startup procedure is set as ended.

FIG. 2C illustrates the program parts of the second start sequence. Initially, the program sequence of the monitoring unit (EMU) is described. In step S23A, the second start sequence is set and set as the status on the CAN bus, reference letter N. Following this, in step S24A, the start valve is activated, wherein the pulse pause ratio is set to one hundred percent (PWM=100%). As a consequence, the starter is now acted upon by the full compressed air. In step S25A, a check is performed as to whether the actual rotational speed nIST is greater than the idling rotational speed LL, for example LL=350 1/min. If this Is not yet the case, query result S25A: no, then in step S26A a temporal stage t, by way of example t=20 s, is set. If this temporal stage is not yet complete, then the program branches back to S25A. Otherwise, the program sequence is continued with step S27A. If it has been detected in step S25A that the actual rotational speed is greater than the idling rotational speed LL, then in step S27A the start valve is deactivated, in step S28A the engagement valve is deactivated and in step S29A the second start sequence Is set as having been completed, reference letter O. In step S30A, this program sequence is then ended.

In step S20, the Interface unit (EIM) deactivates the decompression valve, in other words the decompression valve is actuated in the closing. In step S21, the state variable CTS is set to the status start. Following this, in step S22 a check is performed as to whether the second start sequence is running. For this purpose, the status on the CAN bus, reference letter N, is taken into consideration. If the start procedure has not yet been set, then the program branches back to step S21. If in step S22 an error has been detected, then the start procedure is aborted in step S27, If in step S22 it has been detected that the start procedure is running, then in step S23 the state variable CTS is set to start and in step S24 the startup procedure is set as having been completed. In step S24 in addition the status on the CAN bus, reference letter O, is taken into consideration. Finally, in step S25 the status is set to idle, the start procedure is ended with step S26 and switched into the operation of running the combustion engine.

LIST OF REFERENCE NUMERALS

1 Internal combustion engine
2 Compressed air starting system
3 Starter
4 System controller
5 Engagement valve
6 Start valve
7 Monitoring unit (EMU)
8 Interface unit (EIM)
9 Engine control unit
10 Compressed air storage device
11 PI controller

The invention claimed is:

1. A method for starting an internal combustion engine with a compressed air starting system, comprising the steps of: in a first start sequence, engaging a starter using compressed air, acting on a decompression valve in an opening direction so as to relieve pressure in a cylinder working chamber, and also initiating a procedure of starting up the internal combustion engine by applying pulsed compressed air to the starter; and in a second start sequence acting on the decompression valve in a closing direction and applying constant compressed air to the starter, including determining a compressed air path for bringing the starter into engagement by a system controller via an engagement valve, and determining a compressed air path for starting up the starter via a start valve in the first start sequence and also for rotating the starter in the second start sequence, and further including, during the first start sequence, controlling the start valve via a PWM signal in dependence upon a desired engine rotational speed.

2. The method according to claim 1, including increasing the desired engine rotational speed in a ramp-shaped manner from a first desired rotational speed value to a second desired rotational speed value.

3. The method according to claim 2, including calculating a rotational speed control deviation from the desired rotational speed to an actual rotational speed and ending the first start sequence in a positive manner when it is established that the rotational speed control deviation is within a tolerance band.

4. The method according to claim 3, further including checking a time duration of the rotational speed control deviation.

5. The method according to claim 1, including, during the second start sequence, comparing an actual rotational speed with an idling value, and ending the second start sequence in a positive manner and switching into running operation of the combustion engine when the idling value is exceeded.

* * * * *